US005979977A

United States Patent [19]

Lusch

[11] Patent Number: 5,979,977

[45] Date of Patent: Nov. 9, 1999

[54] PLATE-SHAPED FOOTREST ASSEMBLY FOR A CHAIR

[75] Inventor: Peter Lusch, Bielefeld, Germany

[73] Assignee: Ferdinand Lusch GmbH & Co. KG, Bielefeld, Germany

[21] Appl. No.: 09/071,657

[22] Filed: May 1, 1998

[30] Foreign Application Priority Data

May 2, 1997 [DE] Germany ..... 29707950

[51] Int. Cl.[6] ..... A47C 1/02

[52] U.S. Cl. ..... 297/76; 297/423.34

[58] Field of Search ..... 297/76, 75, 423.35, 297/423.34, 69, 70, 423.36, 68, 423.1

[56] References Cited

U.S. PATENT DOCUMENTS 1,140,211 5/1915 Thomas ..... 297/76

2,770,289 11/1956 McKendrey ..... 297/76 X 5,419,611 5/1995 Cook ..... 297/75 X 5,447,359 9/1995 Asborjnsen et al. ..... 297/423.35

FOREIGN PATENT DOCUMENTS 4934 2/1904 United Kingdom ..... 297/75

*Primary Examiner*—Milton Nelson, Jr.

*Attorney, Agent, or Firm*—Henry M. Friereisen

[57] ABSTRACT

A plate-shaped footrest assembly for a chair; includes a footrest for support of the rear side of the legs of a user, and a footplate for placement of the feet of the user thereon, with the footplate being so linked to the footrest as to permit a pivoting between a stowed position when not being used and an unfolded position when in use. The footplate extends in the unfolded position at an inclination to the footrest. In stowed position, the footplate forms a major central area of the footrest while projecting in the unfolded position almost entirely across a useful support surface of the footrest.

3 Claims, 5 Drawing Sheets

PLATE-SHAPED FOOTREST ASSEMBLY FOR A CHAIR

BACKGROUND OF THE INVENTION

The present invention generally relates to a plate-shaped footrest assembly for a chair, and more particularly to a footrest assembly including a footrest for support of the rear side of the legs of a user, and a footplate for placement of the feet of the user thereon, with the footplate being so linked to the footrest as to permit a pivoting about an axis oriented parallel to a plane of the footrest between a stowed position in which the footplate is not in use and extends in the plane of the footrest, and an unfolded position in which the footplate is in use and extends at an inclination to the footrest.

Plate-shaped footrests for chairs are known in a wide variety of designs. Normally, the footrest is mounted by a pantographic or telescoping scissors-type linkage mechanism to the frame of a chair for swinging from a stored position in which the footrest is located under the seat into an elevated position in which the support surface of the footrest extends approximately at seat level.

It is also known to provide footrests that are equipped with swingable footplates. In conventional footrests of this type, these footplates are relatively small and swingable about an axis that extends approximately in the middle of the footplate. Thus, when pivoting the footplate, only a slight area of the footplate projects upwardly beyond the support surface of the footrest while a same area is pivoted into a space underneath the support surface of the footrest. Such footplates have therefore only a relatively slight effectiveness.

SUMMARY OF THE INVENTION

It is thus an object of the present invention to provide an improved footrest, obviating the afore-stated drawbacks.

In particular, it is an object of the present invention to provide an improved plate-shaped footrest so constructed as to have a footplate which in unfolded position permits the user to comfortably support the feet over the entire foot sole area.

These objects, and others which will become apparent hereinafter, are attained in accordance with the present invention by providing a footrest assembly which includes a footrest and a footplate so linked to the footrest as to permit a pivoting between a stowed position when not being used, and an unfolded position when in use, with the footplate being oriented in the unfolded position at an inclination to the footrest wherein the footplate forms in stowed position a major central area of the footrest and projects in unfolded position almost entirely across a useful support surface of the footrest.

Advantageously, in a footrest assembly according to the present invention, the support surface of the footplate is relatively large and can be exploited nearly entirely as the footplate in the unfolded position projects beyond the support surface of the footrest, while the footrest can be utilized in the stowed position for support of the lower leg and/or the heel.

According to another feature of the present invention, the footrest and the footplate are connected to one another by a linking mechanism for permitting a pivoting of the footplate about an axle, with the linking mechanism including a pivot arm connected to the axle and articulated to the footplate and a guide plate connected to the axle and received in an oblong hole of the footrest. Suitably, a torsion spring is arranged on the axle between the pivot arm and the guide plate and tensioned when pivoting the footplate into the unfolded position so as to effect a return of the footplate back into the stowed position when removing the outside force that acts on the footplate.

In accordance with a modification of the footrest assembly of the present invention, the linking mechanism is so constructed as to permit a pivoting of the footplate about an axle which extends in a front area of the footrest, with the linking mechanism including a lever having one end received in an oblong hole of the footrest and another end articulated to the footplate for holding the footplate in the unfolded position. Suitably, the articulation of the lever to the footplate is effected by an angle bracket which is secured to the footplate, and a hinge bolt which extends through the angle bracket and the lever, with a torsion spring being arranged on the hinge bolt between the lever and the mounting plate and tensioned when pivoting the footplate into the unfolded position.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
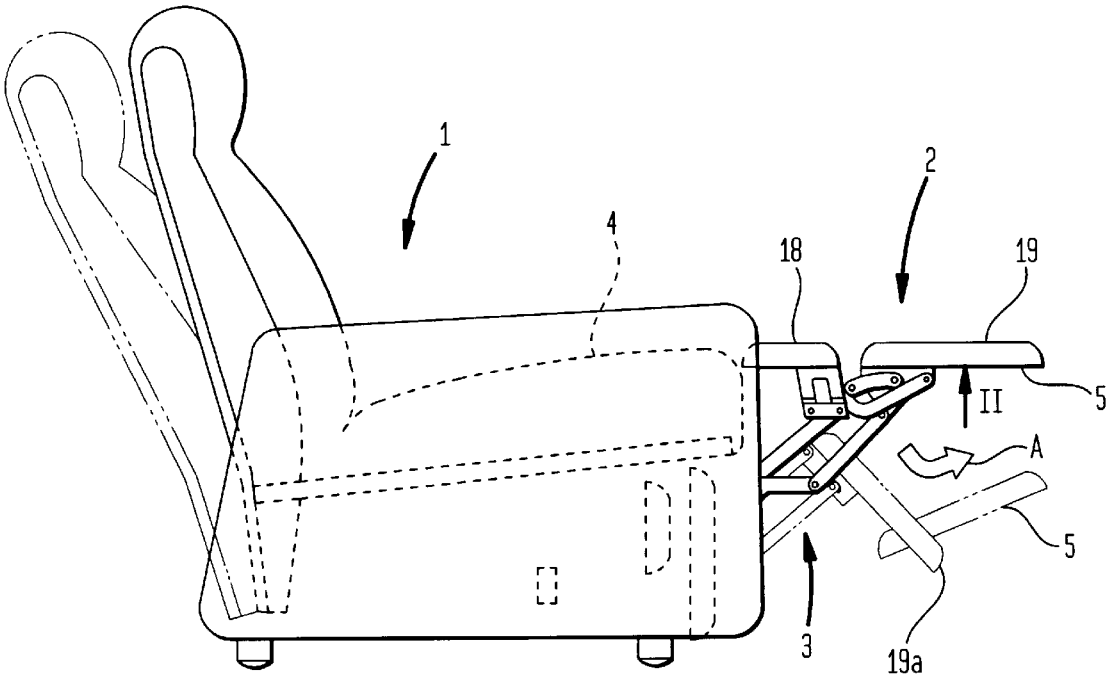
FIG. 1 is a schematic side view of a reclining chair equipped with one embodiment of a footrest assembly according to the present invention, showing the chair in a forward position and a reclining position and the footrest assembly in various operating positions.

Throughout all the Figures, same or corresponding elements are generally indicated by same reference numerals.

Turning now to the drawing, and in particular to FIG. 1, there is shown a schematic side view of a chair in the form of a reclining chair, generally designated by reference numeral 1. The chair 1 has a seat 4 and is equipped with a leg and foot rest arrangement according to the present invention, generally designated by reference numeral 2 and connected to the frame of the chair 1 by a pantographic linking mechanism generally denoted by reference numeral 3 for pivoting the leg and foot rest arrangement 2 between a stored position in which the leg and foot rest arrangement 2 is retracted within the chair 1 under the seat 4, as indicated in dashdot lines, and an elevated position in which the leg and foot rest arrangement 2 extends at seat level, as indicated in continuous lines in FIG. 1.

The leg and foot rest arrangement 2 includes an inner leg rest 18 immediately adjacent the seat 4 of the chair 1 in elevated position for support of the rear side of the upper part of the lower legs of a user, and a footrest assembly 19 suitably linked to the leg rest 18 for support of the rear side of the lower part of the lower legs and the feet of the user. The footrest assembly 19 is comprised of a footrest 19*a* and a footplate 5 which is so linked to the footrest 19*a* as to pivot between a stowed position in which the footplate 5 is integrated within the footrest 19*a*, and an unfolded position in which the footplate 5 extends at an angle to the footrest 19*a*, as indicated by broken lines in FIG. 1, with arrow A depicting the pivot direction of the footplate 5 from the stowed position into the unfolded position.

Thus, the leg and foot rest arrangement 2 is adjustable between three operational positions, shown schematically in FIG. 1, i.e. the stored position in which the leg rest 18 and the footrest assembly 19 are located within the chair 4, with the footplate 5 being stowed in the footrest 19*a*, the elevated position in which the leg rest 18 and the footrest assembly are raised to seat level, with the footplate 5 being stowed in the footrest 19*a*, and an intermediate position in which the leg rest 18 is hidden within the chair 4 and the footplate 5 is swung outwardly at an angle to the footrest 19*a* to occupy the unfolded position.

Figure 2:
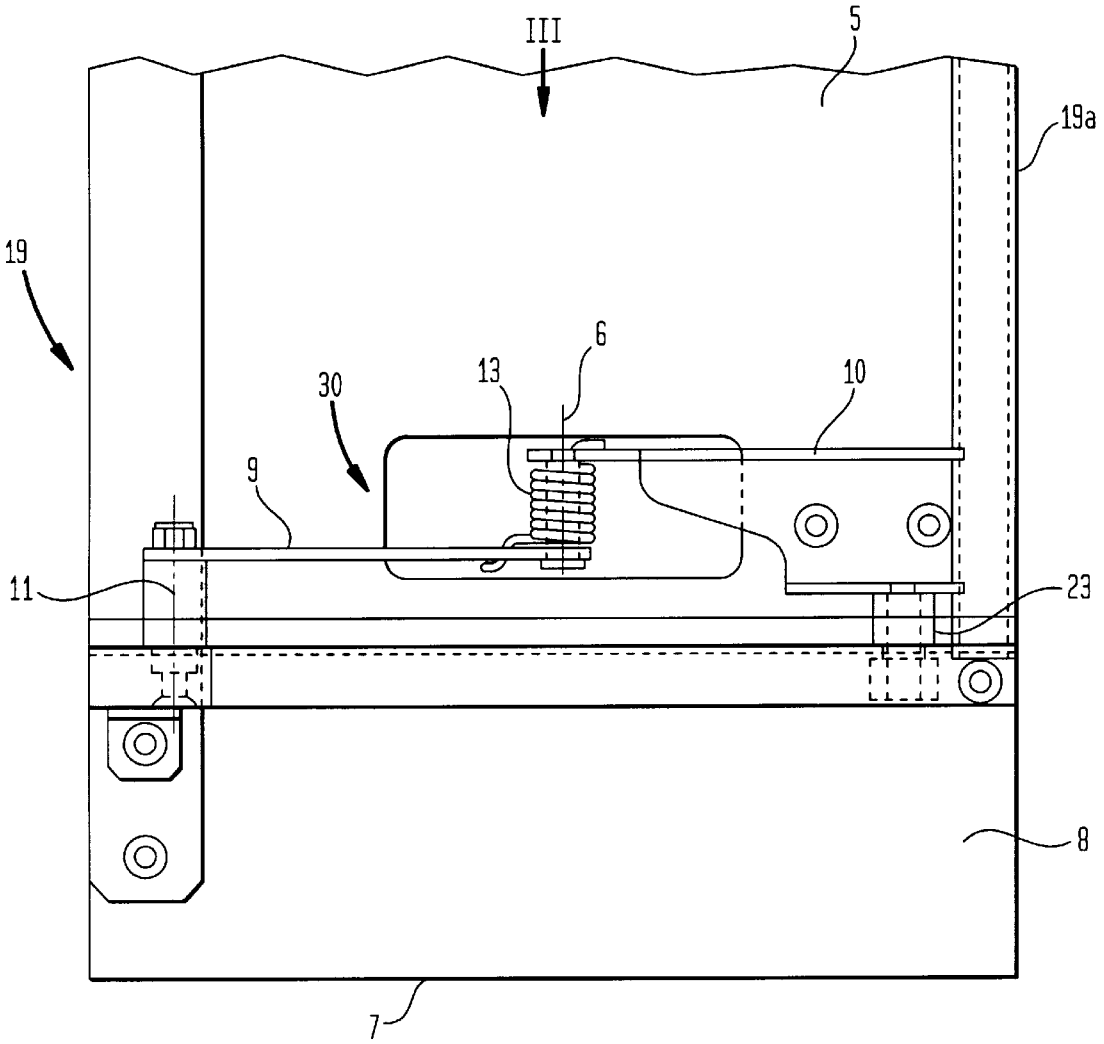
FIG. 2 is a partial bottom plan view of the footrest assembly, taken in direction of arrow II in FIG. 1.

Referring now to FIG. 2, there is shown only one half of the footrest 19*a* and the footplate 5 of the footrest assembly 19. As the other half of the foot assembly 19 is of an identical construction, only this one half will hereinafter be described in detail. The footplate 5 is pivotable between the stowed position and the unfolded position about an axle 6 which extends parallel to the plane of the footrest 19*a* and forms part of a linking mechanism, generally denoted by reference numeral 30. The linking mechanism 30 further includes a pivot arm 9 which has one end secured to the axle 6 and another end articulated to the footrest 19*a* for rotating about a fixed pivot joint 11, and a guide plate 10 which has one end secured to the axle 6 at a distance to the pivot arm 9. The other end of the guide plate 10 is formed with a guide member 23, e.g. a guide roller or glider, which is received in an oblong hole 12 for movement in a longitudinal direction. The oblong hole 12 is formed in an adjacent skirt 8 which is secured to the footrest 19*a*. Arranged on the axle 6 and extending between the pivot arm 9 and the guide plate 10 is a torsion spring 13 which becomes tensioned when the footplate 5 is swung outwardly from the stowed position, shown in FIG. 3, into the unfolded position, shown in FIG. 4. Thus, the footplate 5 returns automatically into the stowed position, when removing an external force upon the footplate 5.

Figure 3:
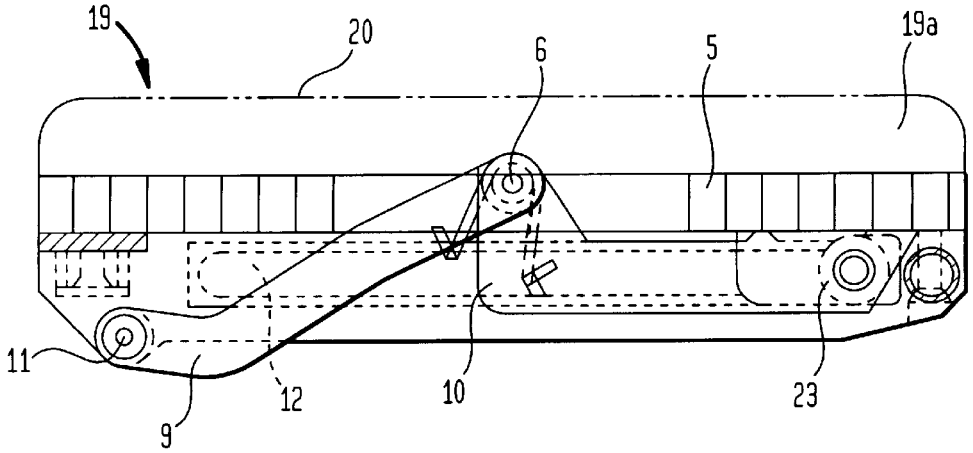
FIG. 3 is a side view of the footrest assembly, taken in direction of arrow III in FIG. 2 and showing the footplate in a position stowed within the footrest.
Figure 4:
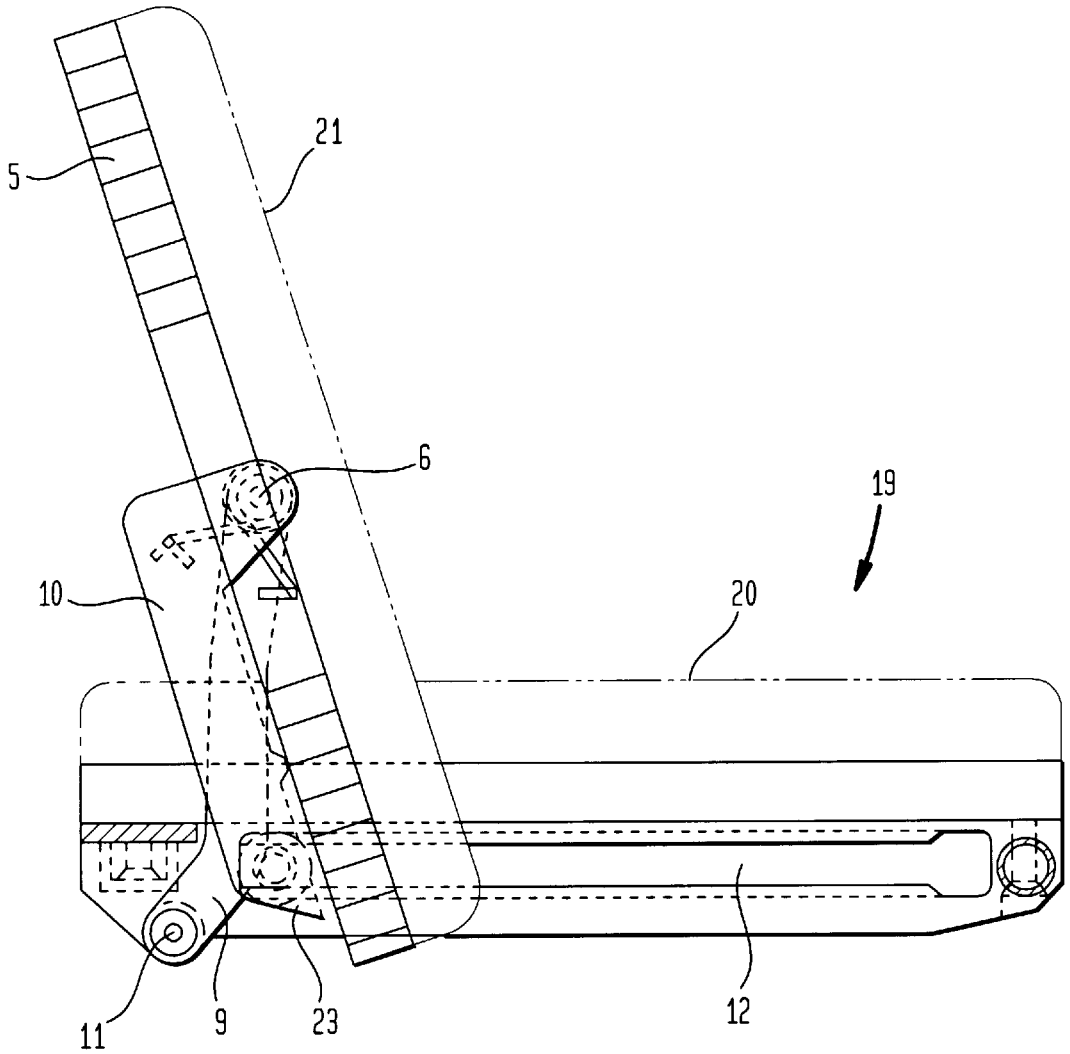
FIG. 4 is a side view of the footrest assembly of FIG. 3, showing the footplate in an unfolded position.

Unfolding of the footplate 5 is effected by the occupant of the chair 1 by applying a force onto the footplate 5 so that the footplate 5 is swung from the stored position, shown in FIGS. 2 and 3 into the unfolded position, shown in FIG. 4. During outward swinging of the footplate 5 from the footrest 19*a*, the pivot arm 9 swings about the pivot joint 11 and the guide plate 10 is shifted via the guide member 23 within the oblong hole 12 in the plane of the footrest 19*a* and simultaneously pivoted in the axle 6. When removing the force applied by the user on the footplate 5, the biased torsion spring 13 returns the footplate 5 into the stowed position.

The footplate 4 is so designed as to have a size which forms a major portion of the footrest 19*a* of the footrest assembly 19 when the footrest assembly 19 occupies the stored and elevated positions shown in dashdot lines and continuous lines, respectively, in FIG. 1 to provide support for the legs and feet. As best seen from FIG. 2, the footplate 5 is arranged in the center between opposite lateral end edges 7 of the footrest 19*a* and extends almost entirely over the depth of the footrest assembly 19. At both sides thereof, the footrest 19*a* is provided with skirts 8 which are of significantly narrower dimensions than the footplate 5 and bound the footplate 5 when the footplate 5 is retracted into the stowed position and received in a complementary cutout of the footrest 19*a*.

In its stowed position, as shown in FIG. 3, the footplate 5 extends in a common plane with the skirts 8 to thereby form an integral part of the footrest 19*a*. When being swung outwardly into the unfolded position, shown in FIG. 4, the footplate 5 projects nearly entirely beyond the useful support surface 20 of the footrest 19*a* so that the feet of the user can be supported by the footplate 5 over the entire foot sole area.

Figure 5:
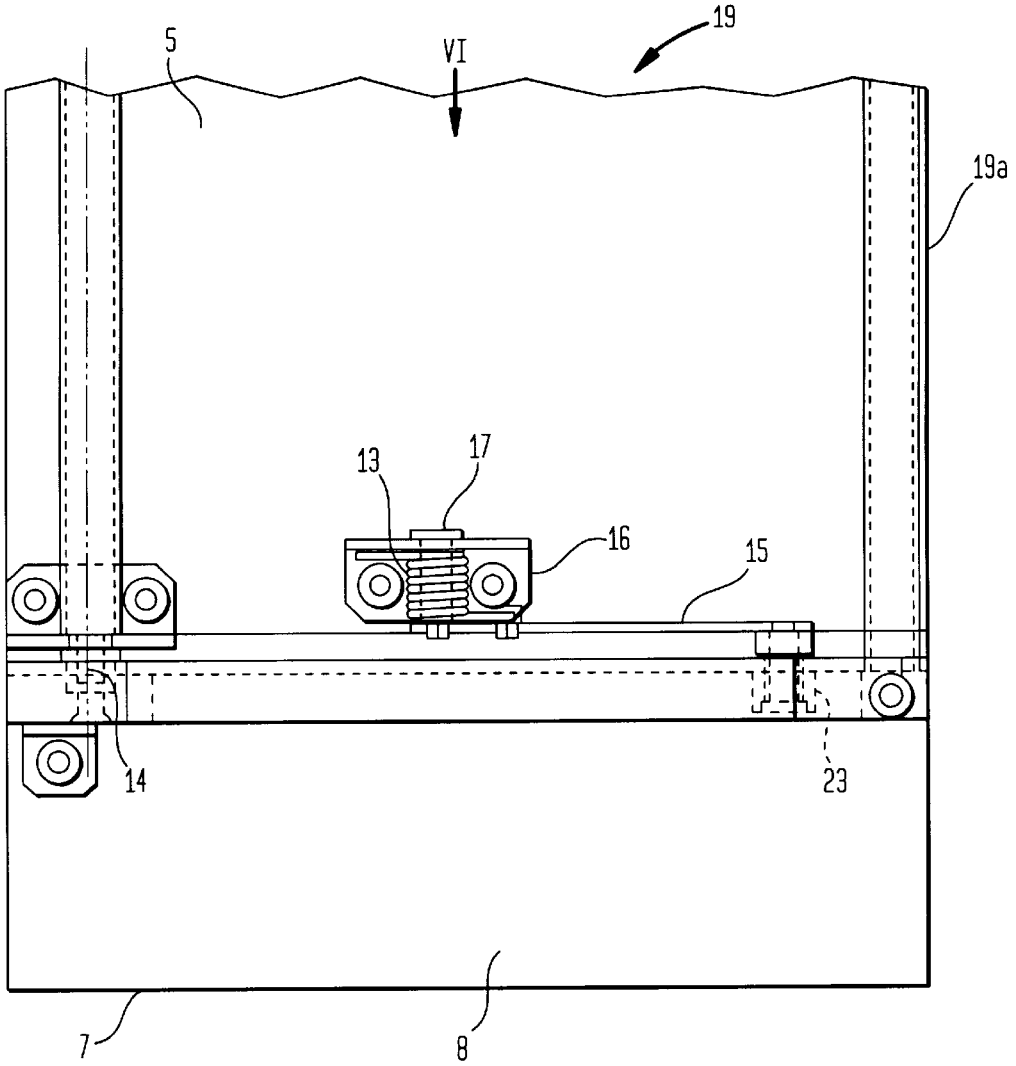
FIG. 5 is a partial bottom plan view of another embodiment of a footrest assembly according to the present invention.
Figure 6:
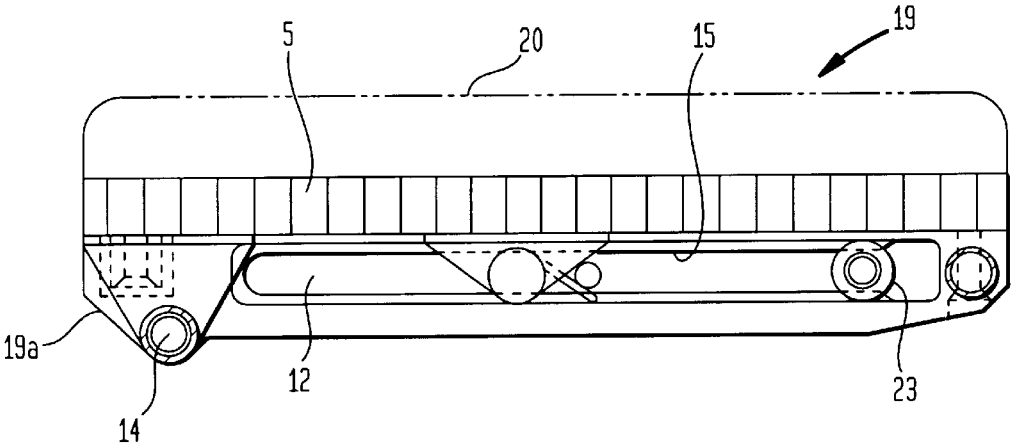
FIG. 6 is a side view of the footrest assembly, taken in direction of arrow VI in FIG. 5 and showing the footplate in a position stowed within the footrest.
Figure 7:
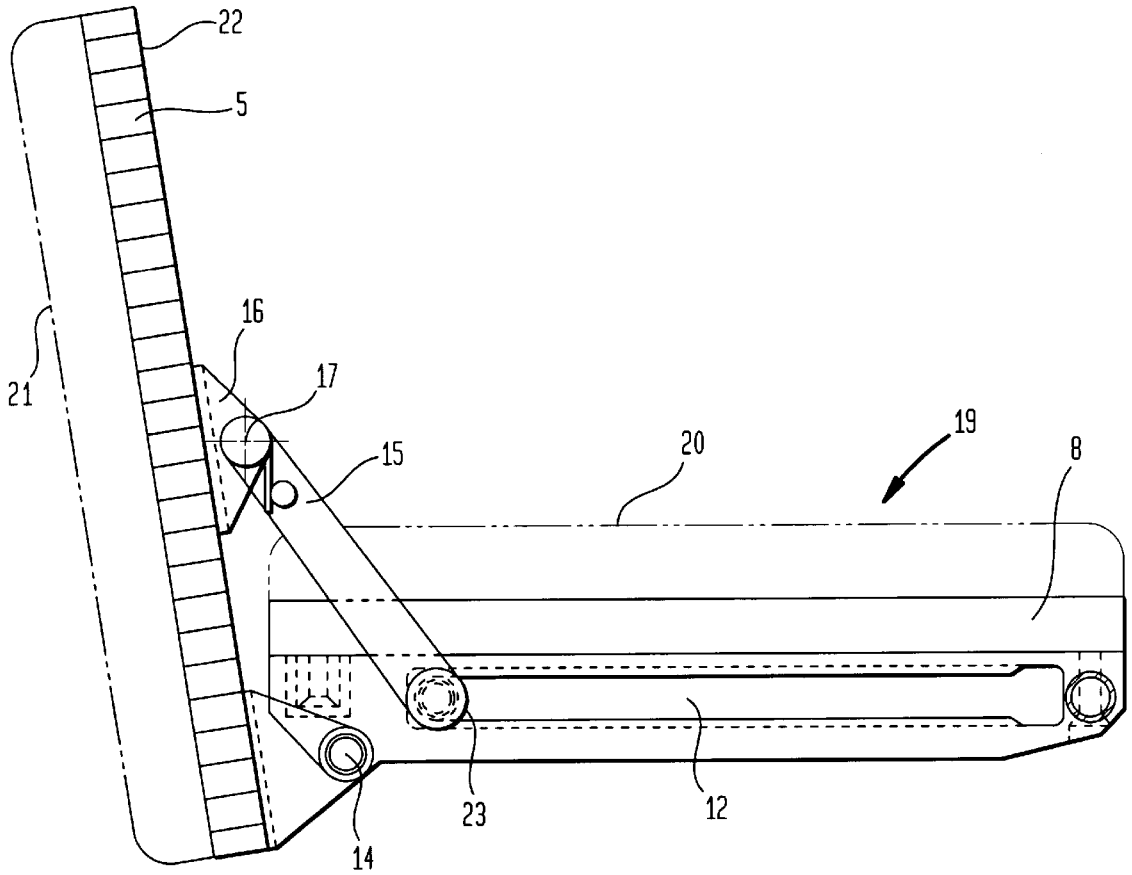
FIG. 7 is a side view of the footrest assembly of FIG. 5, showing the footplate in an unfolded position.

Turning now to FIGS. 5 to 7, there is shown another embodiment of a footrest assembly 19, in which the footplate 5 is swingably mounted about a pivot axle 14 securely fixed to a forward end area of the footrest 19*a*. The footplate 5 is mounted to the footrest 19 by a brace 15 which has one end formed with a guide member 23, e.g. a guide roller or glider, and received in an oblong hole 12 of the adjacent skirt 8 of the footrest 19*a* and another end articulated for pivoting about a hinge bolt 17 to an angle bracket 16 which is securely fixed to the inside surface 22 of the footplate 5. As shown in FIG. 5, the hinge bolt 17 carries a torsion spring 13 which extends between a shank of the angle bracket 16 and the brace 15. When moving the footplate 5 into the unfolded position, e.g. by applying pressure onto the footplate 5, the torsion spring 13 is tensioned to generate the return forces necessary to automatically retract the footplate 5 into the stowed position, shown in FIG. 6, within the footrest 19*a* when removing an external force on the footplate 5.

In the foot assembly 19 according to FIGS. 5 to 7, the footplate 5 forms in the stowed position a substantial central area of the footrest 19*a* while projecting almost entirely in the unfolded position beyond the useful support surface 20 of the footrest 19*a* at an inclination thereto, as shown in FIG. 7.

The difference between both embodiments resides in the fact that the footplate 5 of the foot assembly according to FIGS. 1 to 4 is so pivoted that only the top side of the footplate 5 is exploited for support of the feet while the footplate 5 of the foot assembly according to FIGS. 5 to 7 utilizes the top side 21 in the stowed position for support of the feet and the underside 22 in the unfolded position for support of the feet.

Persons skilled in the art will understand that the guide and swinging means for the footrest assembly is duplicated on the opposite side of the footrest assembly. For convenience, much of the foregoing description is made only in relation to one side of the footrest assembly, when in fact the two sides of the footrest assembly are mirror images of one another about an imaginary vertical medial plane which bisects the left from the right of the footrest assembly.

While the invention has been illustrated and described as embodied in a plate-shaped footrest assembly for a chair, it is not intended to be limited to the details shown since various modifications and structural changes may be made without departing in any way from the spirit of the present invention.

What is claimed as new and desired to be protected by Letters Patent is set forth in the appended claims:

1. A plate-shaped footrest assembly for a chair; comprising:

a footrest for support of a rear side of the legs of a users;

a footplate for placement of the feet of the user thereon, said footplate being so linked to the footrest as to permit a pivoting between a stowed position when not being used and extending in a plane of the footrest and an unfolded position when in use, with the footplate extending in said unfolded position at an inclination to the footrest, said footplate forming in stowed position a major central area of the footrest and projecting in unfolded position almost entirely across a useful support surface of the foot rest; and a linking mechanism provided between the footrest and the footplate for permitting a pivoting of the footplate about an axle, said linking mechanism including a pivot arm connected to the axle and articulated to the footplate and a guide plate connected to the axle and received in an oblong hole of the footrest, wherein the linking mechanism includes a torsion spring supported by the axle between the pivot arm and the guide plate and tensioned when swinging the footplate into the unfolded position.

2. A plate-shaped footrest assembly for a chair; comprising:

a footrest for support of a rear side of the legs of a user;

a footplate for placement of the feet of the user thereon, said footplate being so linked to the footrest as to permit a pivoting between a stowed position when not being used and extending in a plane of the footrest and an unfolded position when in use, with the footplate extending in said unfolded position at an inclination to the footrest, said footplate forming in stowed position a major central area of the footrest and projecting in unfolded position almost entirely across a useful support surface of the footrest; and a linking mechanism provided between the footrest and the footplate for permitting a pivoting of the footplate about an axle extending in a front area of the footrest, said linking mechanism including a lever having one end received in an oblong hole of the footrest and another end articulated to the footplate for holding the footplate in the unfolded position.

3. The footrest assembly of claim 2 wherein the linking mechanism includes a angle bracket secured to the footplate, a hinge bolt extending through the angle bracket and the lever for articulating the other end of the lever to the footplate, and a torsion spring supported by the hinge bolt between the lever and a mounting plate and tensioned when pivoting the footplate into the unfolded position.

* * * * *